United States Patent [19]

Ikemoto

[11] Patent Number: 4,568,818

[45] Date of Patent: Feb. 4, 1986

[54] HEAT CUTTER FOR PLASTIC WRAPPING FILMS USING FILM RESISTORS

[76] Inventor: Shigeru Ikemoto, 36, Honmaeda-cho, Nakagawa-ku, Nagoya, Japan

[21] Appl. No.: 577,298

[22] Filed: Feb. 6, 1984

Related U.S. Application Data

[63] Continuation-in-part of Ser. No. 360,625, Mar. 22, 1982, abandoned.

[30] Foreign Application Priority Data

Mar. 24, 1981 [JP] Japan ..... 56-040962

[51] Int. Cl.[4] ..... H05B 1/00; B65B 11/02

[52] U.S. Cl. ..... 219/221; 53/219; 83/170; 219/214; 338/308

[58] Field of Search ..... 219/214, 216 PH, 221; 338/308; 428/43; 83/170, 171; 101/25; 156/581, 583.4; 53/219

[56] References Cited

U.S. PATENT DOCUMENTS

| | | | |
|---|---|---|---|
| 2,242,645 | 5/1941 | Frost | 83/170 |
| 2,759,618 | 8/1956 | Vogt | 219/214 |
| 2,929,907 | 3/1960 | Collins | 219/214 |
| 3,131,278 | 4/1964 | Rosenthal | 219/214 |
| 3,551,259 | 12/1970 | Schwarzkopf | 156/581 |
| 3,579,949 | 5/1971 | Michels | 53/219 |
| 3,584,572 | 6/1971 | Apicella | 101/25 |
| 3,616,990 | 11/1971 | Powell | 206/608 |
| 3,716,132 | 2/1973 | Lewyckyj | 428/43 |
| 3,736,406 | 5/1973 | Vossen et al. | 219/216 PH |
| 4,017,712 | 4/1977 | Baraff et al. | 219/216 PH |
| 4,139,669 | 2/1979 | Chang | 428/43 |

*Primary Examiner*—C. L. Albritton
*Assistant Examiner*—Geoffrey S. Evans
*Attorney, Agent, or Firm*—Carroll F. Palmer

[57] ABSTRACT

A hand wrapper for plastic film that thermally cuts a length of plastic wrapping film withdrawn from a supply roll includes an improved heat cutter that uses film resistors instead of a metal blade or a single heater wire for the cutting because the film resistors are not likely to break and they have low heat capacity which permits instantaneous cutting of the plastic film without requiring preheating which causes large power losses.

7 Claims, 8 Drawing Figures

HEAT CUTTER FOR PLASTIC WRAPPING FILMS USING FILM RESISTORS

CROSS REFERENCE TO RELATED APPLICATIONS

This application is a continuation-in-part of copending application Ser. No. 360,625, filed Mar. 22, 1982, now abandoned.

BACKGROUND OF THE INVENTION

1. Field of the Invention

This invention relates to hand wrappers for plastic film. More particularly, it concerns thermal cutters in such hand wrappers for cutting plastic wrapping films or the like by application of heat.

2. Description of the Prior Art

For wrapping or packaging goods in plastic films or the like, it has been known in the art to employ hand wrappers which generally consist of a heat cutter for thermally cutting a desired length of plastic film withdrawn from a supply roll and a heat sealer for thermally welding overlapped portions of wrapped film. The heat cutters in such hand wrappers are usually a single heater wire which is spanned transversely across the wrapper (see U.S. Pat. Nos. 3,131,278 and 3,579,949) or by a metal blade which is embedded with an elongated heater element (see U.S. Pat. No. 3,452,511). However, a difficulty is encountered in either case. Namely, in the case of the wire cutters, they are repeated subjected to film pressure and are susceptible to becoming disconnected, while in the blade cutters, they have large heat capacity and low response to heat rise, thereby requiring preheating before use with resultant waste of substantial amounts of energy.

OBJECTS

A principal object of the present invention is the provision of improved forms of heat cutters for plastic wrapping film or the like in hand wrappers.

Further objects include the provision of:

1. Such improved heat cutters designed to prevent wire disconnection and reduce power consumption.

2. Improved forms of hand wrappers for wrapping goods in plastic wrapping or packaging films or the like.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

These objects are accomplished, in part, according to the present invention by the provision of a thermal cutter for cutting by application of heat a length of plastic wrapping or packaging film withdrawn from a supply roll, such thermal cutter comprising a heater having an elongated support body and a row of film resistors securely mounted on the upper side of the support body for contact with a portion of withdrawn film and a heater switch adapted to be closed in relation with pulling action on the film to supply current to the film resistors when the film is withdrawn.

The objects are further accomplished by the provision of hand wrappers comprising a box-like casing accommodating therein a roll of plastic film rotatably supported on a pair of support rolls and having an opening in its top wall through which the leading end of the plastic film passes for withdrawal and a rocker bar mounted for rocking motion in the casing at a position in front of the the casing opening. Such bar has on its rear side a riser wall portion for association with the plastic film withdrawn through the opening, on its front side a shelter box extending across its width and a slot on its upper side. A spring biases the rocker bar upwardly against the downward thrust of film being pulled thereover.

A heater is provided having a row of film resistors mounted on the upper side of an elongated heater support body and normally accommodated in the shelter box with the film resistors being exposed through the slot on its upper side for contact with a portion of the withdrawn film when the rocker bar is rocked by forwardly pulled film against the biasing action of the spring.

A heater switch is mounted beneath the rocker bar and is adapted to be closed when the rocker bar is rocked by the forwardly pulled film to supply current to the film resistors.

BRIEF DESCRIPTION OF THE DRAWINGS

A more complete understanding of the invention can be obtained by reference to the drawings in which like component parts are designated by like reference numerals throughout the various figures and in which.

DESCRIPTION OF THE PREFERRED EMBODIMENTS

Figure 1:
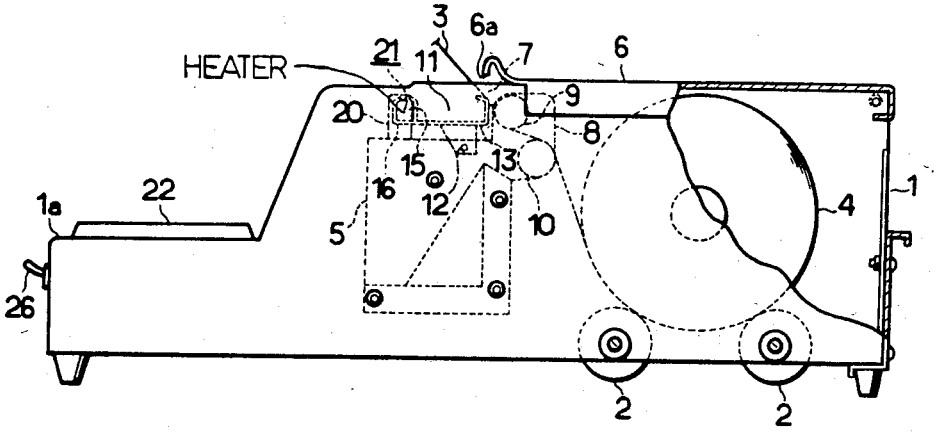
FIG. 1 is a partly cutaway schematic lateral elevation of a hand wrapper constructed in accordance with the present invention.
Figure 2:
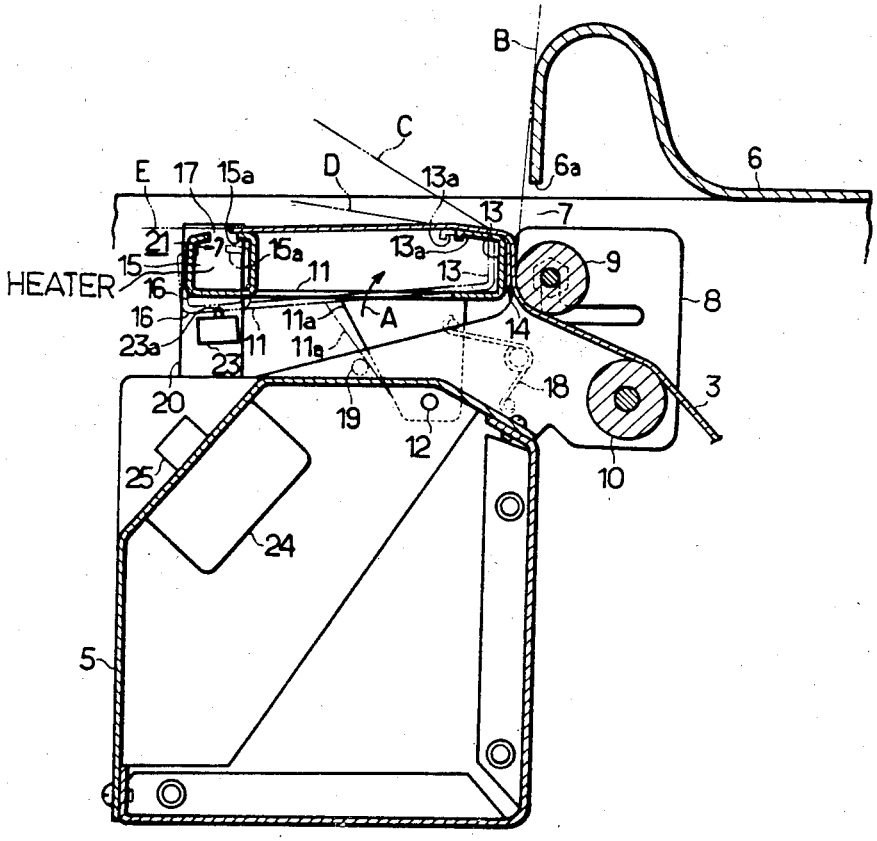
FIG. 2 is a fragmentary, vertical sectional view showing on an enlarged scale primary component parts of the hand wrapper.

Referring in detail to the drawings and first to FIGS. 1 and 2, a hand wrapper made in accordance with the present invention comprises a box-like casing 1 with a flat terrace 1*a* in its front portion. Mounted rotatably on the lower portions of side walls of the casing 1 are a pair of rollers 2 which rotatably support a roll 4 of plastic wrapping film 3. The casing 1 accommodates a distributor box 5 in its front portion and has on its top a lid member 6 which is hingedly connected to the casing 1 at its rear side and which is normally in closed position. The front edge 6*a* of the lid 6 is spaced from the distributor box 5 defining therebetween an exit 7 for the wrapping film 3 to be withdrawn out of the casing 1.

Integrally projected from opposite lateral sides of the distributor box 5 are brackets 8 which rotatably support a couple of rollers 9 and 10.

A rocker bar 11 is pivotally supported in the upper portion of the casing 1 through a bracket 11*a* and a pin 12 in a position forward of the film exit 7. The rocker bar 11 has its rear edge portions folded inward to from a riser wall portion 13 with a smooth cloth padding 14 on its rear side. The front portion of the rocker bar 11 is also folded to form a shelter box 16 which defines therein a compartment 15 with an opening or slot 17 on the upper side.

A torsion coil spring 18 is provided between the outer wall surface of the distributor box 5 and the rocker bar 11 to constantly urge the bar in the direction indicated by arrow A so the the rear riser portion 13 of the rocker bar 11 abuts against the roller 9 through the cloth padding 14. A stopper pin 19 which is fixed on the inner wall of the casing 1 engages with the pivoting bracket 11*a* of the rocker bar 11 to limit the rotational angle of the rocker bar 11 in a direction counter to the direction of the arrow A.

The distributor box 5 is provided with a pair of posts 20 in laterally opposed positions in the front portion of its top wall (only one of the posts 20 is shown) to support a heater 21 of the thermal film cutter across the width of the rocker bar 11. The heater 21 is normally positioned within the compartment 15 of the shelter box 16 and its upper edge is exposed through the opening 17 when the rocker bar 11 is turned in the direction counter to the arrow A direction.

A heater plate 22 of a heat sealer is mounted on the front terrace 1*a* of the casing 1. When the rocker bar 11 is turned counterclockwise (a direction counter to the arrow A), the lower side of the heater depresses an actuator 23*a* of the microswitch 23 which is mounted on the post 20, thereby closing the switch 23 to complete a current supply circuit to the heater 21.

Mounted on the outer side of the distributor box 5 is a current adjuster knob 25 to adjust the width of impulse current which is supplied from an impulse current generator 24 provided in the distributor box 5. The impulse current generator 24 supplies the heater 21 with intermittent impulse current of a width as controlled by the current adjuster knob 25.

A power switch 26 is mounted on the front side of the terrace 1*a* of the casing 1.

Figure 4:
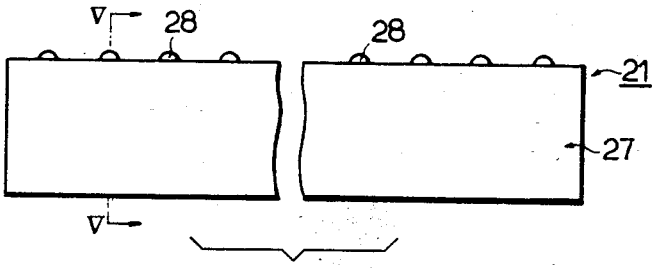
FIG. 4 is an enlarged front view of a heater cutter member of the new hand wrappers.
Figure 5:
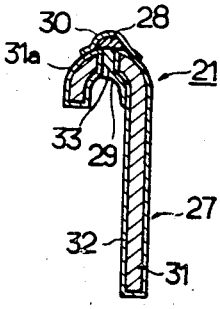
FIG. 5 is a cross-sectional view taken on line V—V of FIG. 4, FIGS. 6 and 7 are views similar to FIGS. 2 and 4, respectfully, but showing another embodiment of the present invention.

FIGS. 4 and 5 show the construction of the heater 21, which comprises a heater support body 27, film resistors 28 serving as heat generators, conducting strips 29 and a protective surface layer 30. The heater support 27 consists of a transversely extending elongated steel plate 31 and a coated enamel layer 32. The upper edge of plate 31 is semicircularly curved to one side as shown at 31*a* and has a row of perforations 33 along the length of the curved top 31*a*. An enamel layer 32 covers substantially the entire surfaces of the plate 31, including the inner peripheries of the perforations 33.

Conducting strips 29 for the respective resistors 28 are inserted into the perforations 33 from the lower side of the curved top 31*a*. The film resistors 28 have a construction similar to the of known thermal print heads and are in the form of dots of, for example, printed resistors of a carbon-resin material. The resistors 28 are secured on the surface of the curved top 31*a* of the heater support plate 31 contiguously with the respective perforations 29. The protective surface layer 30 is formed of a thin ceramic layer to reduce its heat capacity and coated at least to cover the film resistors 28.

Figure 8:
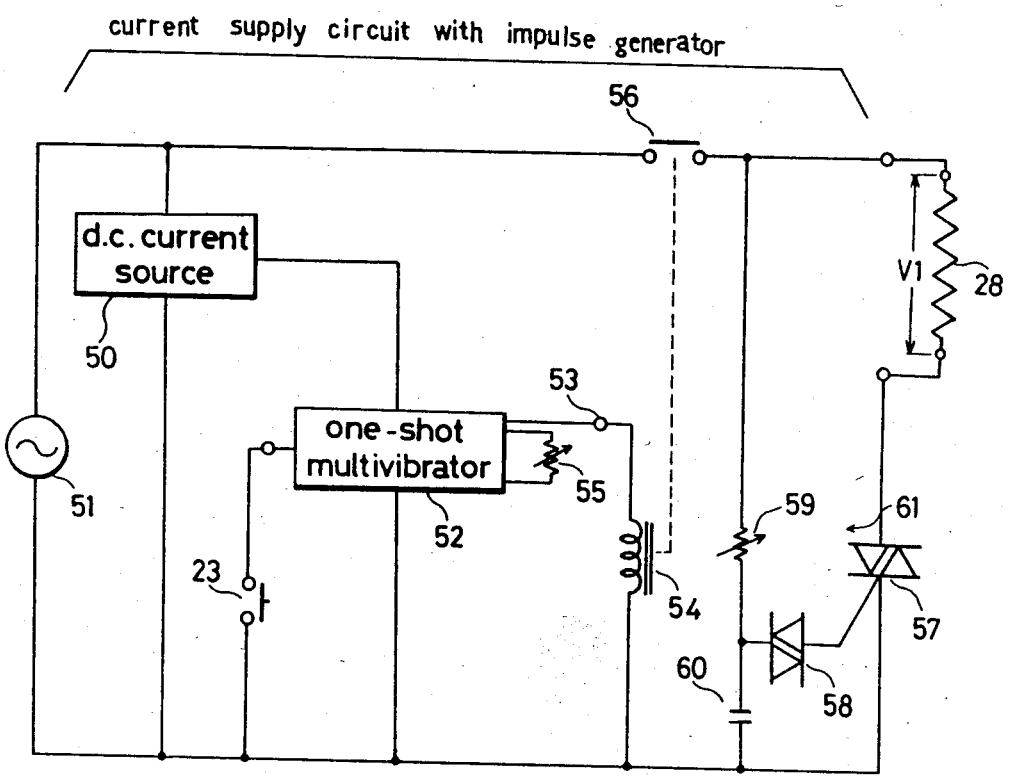
FIG. 8 is a schematic view of a current supply circuit with impulse generator for use in the new hand wrappers.

In FIG. 8, which depicts a current supply circuit with impulse generator, a d.c. power source 50 converts a.c. current from an a.c. power source 51 into low voltage direct current to be employed as a power source of the one-shot multivibrator 52. The multivibrator 52 generates one pulse to an output terminal 53 to supply it to a relay 54 when the multivibrator 52 is given a trigger signal upon closing of the switch 23. The pulse thus generated is adjusted as to its time interval width by means of a rheostat 55. Meanwhile, the relay 54 keeps its contact 56 closed for a period of time, the length of which is equivalent to the width of the pulse supplied to the output terminal 53, thus causing a.c. voltage (V1) to energize the film resistor 28. The voltage (V1) thus impressed is adapted to have a magnitude of less than that of the output voltage from the a.c. power source 51 by means of the well-known voltage control circuit 61 comprising a thyristor 57, a trigger element 58, a rheostat 59 and a condenser 60.

In operation, the power switch 26 is first turned on whereupon the heat seal plate 22 is energized. Then, a necessary length of the film 3 is withdrawn by pulling upward its leading end which is led out from the exit 7 through the gap space between the roller 9 and abutting riser portion 13 of the rocker bar 11. In this instance, if the film 3 is pulled out in the range indicated by chain lines B and C in FIG. 2, the film 3 is withdrawn smoothly by sliding contact with the padding cloth 14 without abutting against the rear riser portion 13 of the rocker bar 11.

Figure 3:
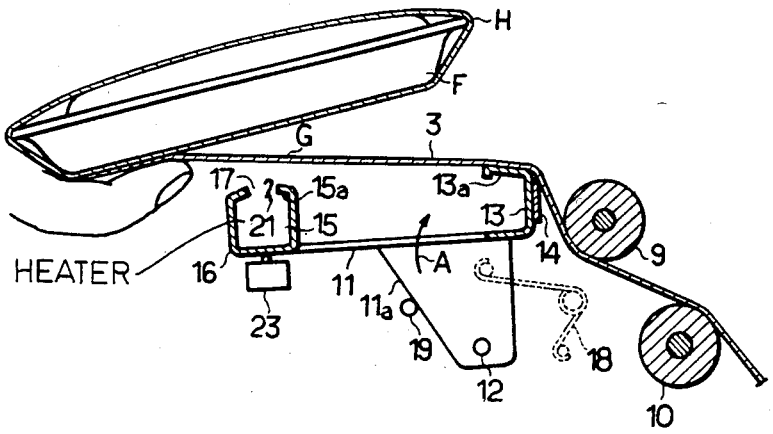
FIG. 3 is a schematic illustration employed for the explanation of the hand wrapper.

The film 3, which has been withdrawn in this manner, is wrapped around goods F as shown particularly in FIG. 3 and then is pulled forcibly in the direction indicated by the chain line D while moving the wrapping forward as indicated by the chain line E. By so doing, the film 3 is intimately contacted with the top flat portion 13*a* of the rear riser portion 13 and is braked by its own adhesive force thereby tensioning the film portion which is wrapped around the goods F. On the other hand, upon pulling the film 3 in the direction E, the rocker bar 11 is turned about the pin 12 in the direction counter to the arrow A against the biasing force the the spring 18. As a result of this angular rotation of the rocker bar 11, the top wall surface of the shelter box 16 is sunken beneath the heater 21 so that the film 3 is pressed against the film resistors 28 on the curved top portion 31*a* of the heater 21 and the actuator 23*a* of the switch 23 is depressed by the bottom wall of the shelter box 16 to close the switch 23. Consequently, impulse current of the desired width is supplied to the film resistors 28. Since the resistors 28 have very small heat capacity, they are quick in temperature rise when energized so they instantly reach a required temperature to thermally cut the film 3 at the position G.

If the impulse current supplied to the film resistors 28 is set at a relatively large width, the heat generated by them has a high calorific value and will diffuse over wide areas to fuse the contacting film portion as well as ambient areas, forming a continuous straight cut in the film 3. On the other hand, with short impulse current width, the film 3 is fused only in limited spots which are in contact with the resistors 28 and therefore torn off by the user of the hand wrapper. After this, the loose hems of the film 3 are wrapped around the goods F and folded on the bottom side of the wrapped goods F. The overlapped film portions on the bottom side of the wrapped goods are welded to each other by placing the bottom side of the package on the heat seal plate 22.

When the film 3 is thermally cut off in a tensioned state as mentioned above, the loosened end of the film 3 tends to contract, but it is met by the shelter case 16 of the rocker bar 11 which is instantly turned in the direction of the arrow A to restore its initial position under the influence of the biasing force of the spring 18. Therefore, the loosened end of the film 3 is caught on the flat rear wall portion 16*a* of the case 16, i.e., the film 3 sticks on the wall portion 16*a* and the riser wall portion 13 of the rocker bar 11 by its self-adhering property in a bridged manner, so that is can be readily picked up in subsequent wrapping.

The above described embodiment of the invention has a number of advantageous effects. For example, the heater 21 with a row of film resistors 28 on the top of the heater support plate 27 us free of disconnections of like damage as experienced in conventional wire heaters. Also, the film resistors 28 being of quick temperature rise can instantly perform a thermal cutting of the film 3 without wasting power through preheating. Further, as the switch 23 is operated in relation with the film withdrawing action, the film resistors 28 are energized only when the film 3 is pressed against the heater 21 permitting power consumption to be reduced to a minimum.

Figure 6:
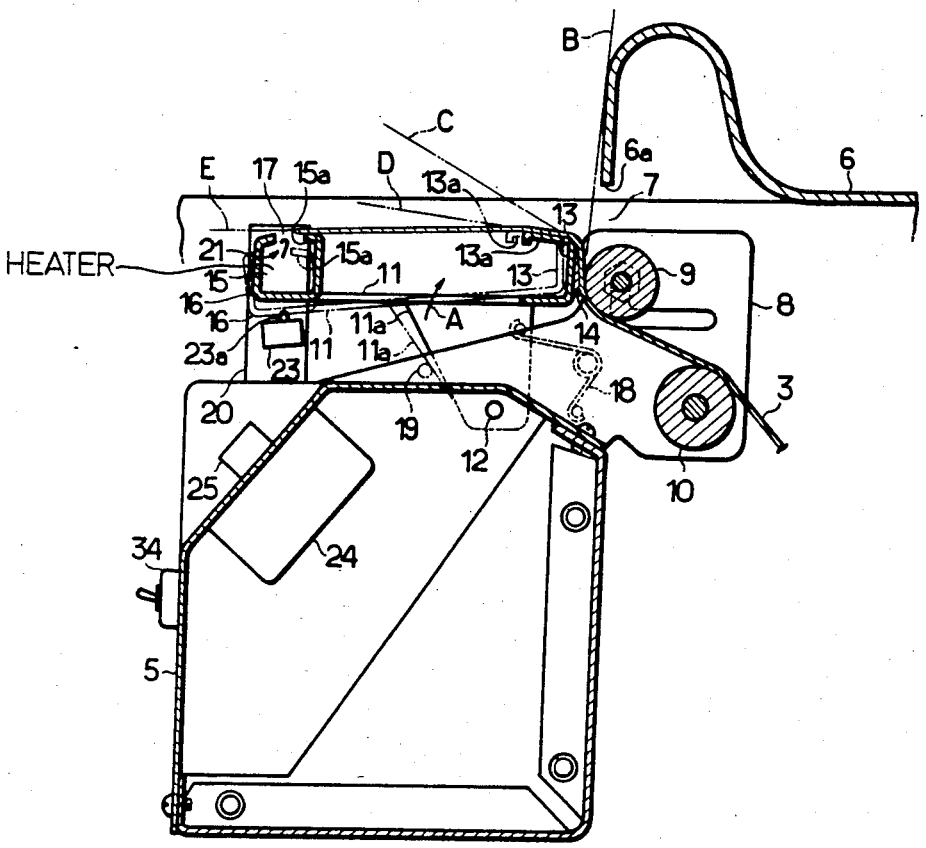
Figure 7:
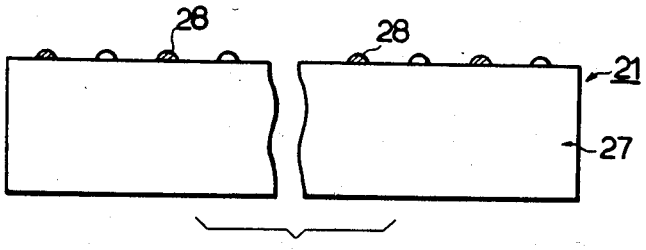

FIGS. 6 and 7 illustrate another embodiment of the invention which is the same as the foregoing first embodiment except for the following features.

Although all of the film resistors 28 in a row are simultaneously turned on in the first embodiment, they are arranged to be energized in two modes or patterns in this second embodiment, namely, a cutting first pattern in which all the film resistors 28 are turned on simultaneously and a cutting second pattern in which every other film resistor (the hatched ones) are turned on. The first cutting pattern is suitable for forming a continuous cut and the second pattern is for a discontinuous cut. Either one or the other of the patterns is selected by way of a switch 34 which is mounted on the outer side of the distributor box 5 to close the corresponding current supply circuit.

The second cutting pattern described above is particularly suitable for thin films since the heat diffusion from the resistors 28 to the film 3 is slightly weakened.

It will be clear from the foregoing description, that an important feature of the present invention resides in the fact that a thermal cutter for cutting a length of plastic wrapping film from a supply roll basically comprises a transversely extending heater support member, a row of film resistors adhesively fixed on the upper surface of the heater support member to be contacted with the wrapping film and a heater switch adapted to be closed in relation with pulling action on the film. Such heater construction has the advantage in being free of damage during use coupled with a quick temperature rise to permit instantaneous cutting of the film without requiring preheating which causes large power losses. In addition, the heater elements in the form of film resistors permit a high degree of freedom in the cut pattern design and make it possible to select arbitrarily optimum patterns for use in the film cutting and heat sealing operations using the new hand wrappers of the invention.

The embodiments of the invention in which an exclusive property or privilege is claimed are defined as follows:

1. A hand wrapping device for plastic film comprising:

a pair of support rollers for supporting a roll of plastic film with the periphery of said roll engaged with each of said rollers, said rollers being secured to a frame, a guide roller disposed in said frame to lead said plastic film exterior of said frame upon film withdrawal from said roll, a rocker bar arranged on said frame to be rockable in association with said film when said film slides thereon as it is withdrawn from said frame, said rocker bar usually holding said film by the self-adhering property of said film and always biased by a spring in the direction reverse to the film withdrawal direction, a lengthwise row of spaced apart film resistors fixed on a support positioned in front of said rocker bar so as to let said film contact said resistors in accompany with the rocking movement of said rocker bar, an impulse generator circuit to supply impulse current to said film resistors when said plastic film contacts said resistors, a power supply switch which is actuated by the rocking movement of said rocker bar to energize said impulse generator circuit, and a heat seal plate positioned in front of said film resistors so that said plastic film with goods wrapped therein may be applied to said plate to seal said film.

2. The hand wrapping device of claim 1 that comprises:

a protective case enclosing said film resistors and having an upper opening through which said resistors may move in association with the movement of said rocker bar.

3. The hand wrapping device of claim 1 that comprises:

an upright riser wall having a non-adhering padding thereon in registration with said guide roller to let said plastic smoothly slide therealong.

4. A hand wrapper comprising:

a casing to accommodate therein a roll of plastic wrapping film rotatably on a pair of support rollers and having an opening in the top wall thereof through which may be withdrawn the leading end of said plastic film, a rocker bar mounted in said casing at a position in front of said opening and having on the rear side thereof a riser wall portion for association with the wrapping film withdrawn through said opening and on the front side a box extending across the width of said rocker bar and a slot on the upper side of said box, a spring biasing said rocker bar upwardly at said front side, a heater having a row of film resistors mounted on the upper side of an elongated support and normally accommodated in said box, at least said film resistors on said support being exposed through said opening of said box for contact with a withdrawn film portion when said rocker bar is rocked by forwardly pulled wrapping film against the biasing action of said spring, and a heater switch mounted beneath said rocker bar and adapted to be closed when said rocker bar is rocked as aforesaid to supply current to said film resistors.

5. A hand wrapper as defined in claim 4 wherein said support comprises an elongated support body of an inverted J-shape in cross-section, a number of perforations formed in the curved top wall portion of said support body at intervals along the length thereof, an enamel layer covering substantially the entire surface of said support body including inner peripheries of said perforations, a row of film resistors securely mounted on said curved top portion contiguously to said perforations, conducting strips inserted in said perforations to connect said film resistors to a power supply circuit and a protective surface layer coated on the upper surface of said curved top wall to cover said film resistors.

6. A hand wrapper as defined in claim 5 wherein said support body is normally accommodated in a box and adapted to be exposed in relation to film pulling to contact said resistors with a withdrawn portion of said film.

7. A hand wrapper as defined in claim 5 wherein said power supply circuit is provided with an impulse current generator for supplying impulse current to said resistors.

* * * * *